United States Patent [19]

Knauss

[11] Patent Number: 4,825,043

[45] Date of Patent: Apr. 25, 1989

[54] ELECTRIC CONTINUOUS FLOW HEATER FOR LIQUID CONTAINERS

[75] Inventor: Hermann Knauss, Oberderdingen, Fed. Rep. of Germany

[73] Assignee: E.G.O. Elektro-Gerate Blanc u. Fischer, Fed. Rep. of Germany

[21] Appl. No.: 887,257

[22] Filed: Jul. 18, 1986

[30] Foreign Application Priority Data

Jul. 23, 1985 [DE] Fed. Rep. of Germany ..... 3526186

[51] Int. Cl.[4] ..... F24H 1/12; F24H 1/18; H05B 1/02; H05B 3/00

[52] U.S. Cl. ..... 219/298; 219/297; 219/299; 219/301; 219/306; 219/312; 219/314; 219/438; 219/441

[58] Field of Search ..... 219/296–299, 219/301–309, 312, 314, 437, 439, 436, 438, 441, 442

[56] References Cited

U.S. PATENT DOCUMENTS

| | | | |
|---|---|---|---|
| 852,854 | 5/1907 | Shoenberg | 219/314 X |
| 1,791,095 | 2/1931 | Hicks | 219/297 X |
| 1,825,793 | 10/1931 | Heroy . | |
| 2,251,411 | 8/1941 | Metzgar | 219/311 |
| 2,519,920 | 8/1950 | Miner | 219/301 |
| 3,126,469 | 3/1964 | Feldmann et al. | 219/297 X |
| 3,247,359 | 4/1966 | Feld | 219/301 X |
| 4,574,183 | 3/1986 | Knauss | 219/439 X |
| 4,590,361 | 5/1986 | Del Fabbro | 219/439 |

FOREIGN PATENT DOCUMENTS

| | | | |
|---|---|---|---|
| 185874 | 10/1985 | European Pat. Off. | 219/301 |
| 299517 | 7/1917 | Fed. Rep. of Germany . | |
| 618004 | 8/1935 | Fed. Rep. of Germany . | |
| 640130 | 12/1936 | Fed. Rep. of Germany . | |
| 1718742 | 10/1955 | Fed. Rep. of Germany . | |
| 6601083 | 8/1966 | Fed. Rep. of Germany . | |
| 2638380 | 3/1978 | Fed. Rep. of Germany | 219/301 |
| 7633515 | 4/1978 | Fed. Rep. of Germany . | |
| 8121389 | 7/1981 | Fed. Rep. of Germany . | |
| 3221348 | 12/1983 | Fed. Rep. of Germany | 219/301 |
| 3241008 | 5/1984 | Fed. Rep. of Germany | 219/437 |
| 857463 | 4/1940 | France | 219/298 |
| 1038837 | 8/1966 | United Kingdom | 219/301 |

*Primary Examiner*—Anthony Bartis

*Attorney, Agent, or Firm*—Steele, Gould & Fried

[57] ABSTRACT

A continuous flow electric heater for heating liquid contained in a liquid container has a plurality of parallel tubular heating ducts (*7b*) each bounded by a tubular wall (*ib*) having upper and lower ends connected respectively to a lower inflow chamber (19*b*) and an upper outflow chamber (31). The inflow chamber (19*b*) forms a collector for solids which many separate from the liquid being heated and is defined by a pot-shaped body having a large area solids removal opening closed by a removable cover (25*b*) and providing access to the interior of the inflow chamber (19*b*) over the entire width thereof, thereby allowing full access to the interior of the ducts (*7b*). A tubular heating resistor (17*b*) is helically wound around each tubular wall portion (8*b*) to heat the liquid flowing therethrough. A common reception tube (27*b*) tangentially engaging each tubular wall (8*b*) between two adjacent turns of the heating resistor thereon removably receives the temperature sensor of a thermal cutout protector. The temperature sensor of a temperature regulator is removably received in the reception tube (35) located in the upper portion of the inflow chamber (19*b*).

31 Claims, 5 Drawing Sheets

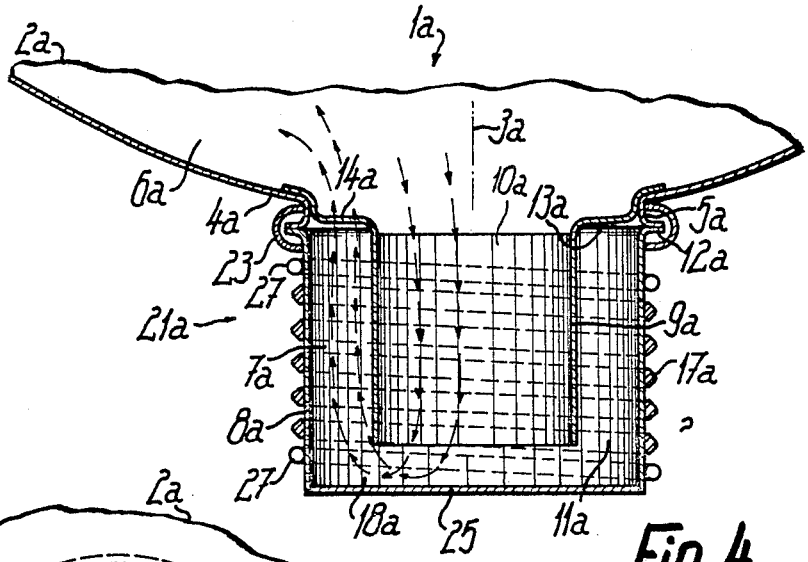
Fig. 4
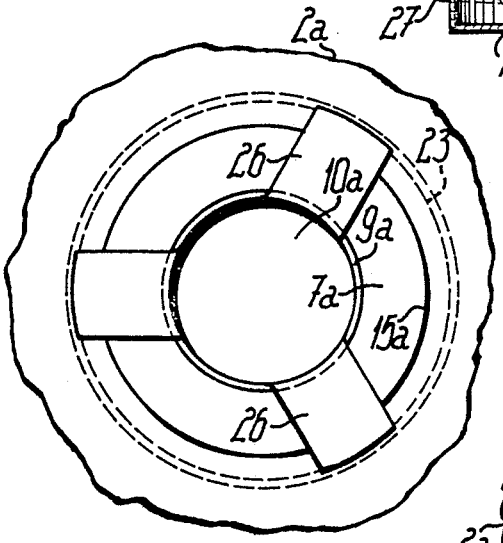
Fig. 5
Fig. 6
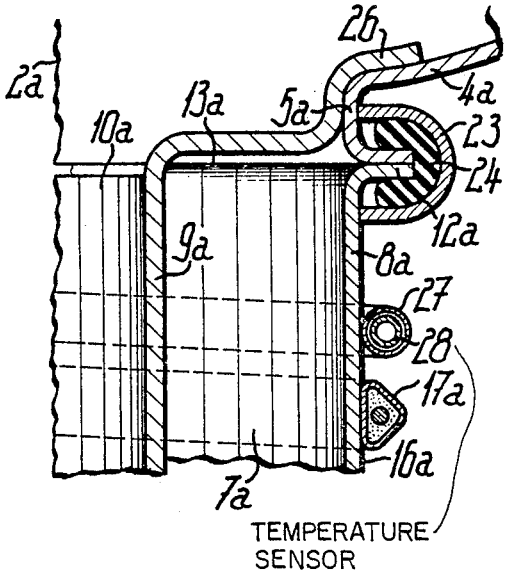

ELECTRIC CONTINUOUS FLOW HEATER FOR LIQUID CONTAINERS

BACKGROUND OF THE INVENTION

The present invention relates to an electric heating means for liquid containers, particularly for hot water equipment, with at least one tubular heater.

For heating liquids in containers, such as hot water tanks, washing machines or the like, in general the heater is associated with the container in such a way that it heats the liquid therein until the desired temperature is reached. Despite possible liquid flow reactions due to the heating means, there are large temperature differences within the liquid in the container and efficiency is not always satisfactory. Particularly when heating hard water considerable solids in the form of lime are also deposited on the interior of the container and can lead to a further deterioration of efficiency, whilst also causing cross-sectional reduction preventing the liquid flow. Cleaning such containers for removing the solids is usually very complicated and time-consuming.

SUMMARY OF THE INVENTION

The problem of the present invention is to provide an electrical heating means for liquid containers, which ensures increased efficiency in a simple manner by a continuous removal of solids.

According to the invention this problem is solved by an electrical heating means of the aforementioned type, in that a continuous flow heater heated by tubular heaters is connected to the inlet and outlet sides of the container and has at least one lower collector for solids removal which can be emptied through a large-area opening. Thus, the liquid is uniformly heated to the desired temperature flowing in a circuit through the container and continuous flow heater, accompanied by a constant thorough mixing, so that the solids appear in the collector of the continuous flow heater and not in the container and can be much more easily removed therefrom than from said container. The liquid flow through the continuous flow heater and therefore through the container can be brought about, according to the invention, by a thermosiphon action and/or by a mechanical pump, such as a circulating pump.

A particularly advantageous construction of the invention is obtained in that the continuous flow heater has at least one flow heating duct, which is heated from at least one side remote from the side subject to the liquid action and in particular from the outside by means of the tubular heater. Thus, the tubular heater or heaters do not come directly into liquid contact and this in particular prevents local overheating and ensures a rapid heat transfer from the tubular heater to the liquid, because the tubular heater heats the heating duct wall in large-area manner and the liquid flows along said wall. Thus, the surfaces coming into contact with the liquid and in particular the liquid-carrying surfaces of the heating duct can be made very smooth and even, so that the tendency towards the deposition of solids is significantly reduced.

The thermosiphon action of the continuous flow heater can, e.g., be brought about in simple manner such that the inlet of the continuous flow heater, particularly the heating duct, e.g., directly emanating from the container, is made lower than the outlet, which also appropriately issues into the container. The inlet and outlet can be vertically superimposed or the outlet can be laterally displaced with respect to the vertical relative to the inlet. In both cases, there are appropriately linear flow paths within the continuous flow heater between the inlet and outlet. In the case of a sloping arrangement of the continuous flow heater, e.g., constructed in the manner of a heating cartridge, the angle of inclination can be adapted to the viscosity of the particular liquid to be heated in that said angle of inclination can be made shallower as the viscosity decreased.

A particularly compact heating means construction, which further improves efficiency, is obtained if the continuous flow heater is at least partly integrated into the container interior and in particular is attached as a shaft to the container bottom at the inlet and outlet sides. Thus, the continuous flow heater and container form a closed assembly and there are very short flow paths between the heater and the container. However, it is also conceivable to connect the continuous flow heater detachably to the container via pipe connections in the form of a separate unit.

As a further development of the invention, the continuous flow heater is provided on the inlet side with a downflow duct, via which the in each case cooler liquid can flow out of the container and directly into the heater. The downflow duct is preferably at least partly located in the heating duct having a rising flow direction and/or is approximately equiaxial to the heating duct, so that in the path from the container to the heating zone of the continuous flow heater, the liquid is not subject to any further cooling and a very space-saving continuous flow heater construction is obtained.

A very favourable liquid flow behaviour is obtained in that the upper end of the downflow duct, which is in particular located above the container bottom, is higher than the continuous flow heater outlet, which is in particular level with the container bottom, so that despite a virtually random container shape a favourable circuit flow within the container is obtained. This is further improved in that at least one flow guiding member for the continuous flow heater outlet flow is provided which is directed away from the downflow duct inlet flow. The flow guidance member is preferably formed by the end of the downflow duct, which is widened in funnel-shaped manner and covers the outlet of the heating duct. In the case of an equiaxial arrangement of the downflow duct and heating duct, as well as with a horizontal outlet or flow guidance member within the container, the heated liquid coming from the continuous flow heater is directed away from the central axis of the flow guidance member and introduced into the container, whilst the liquid flowing to the heater is concentrated in an area immediately around said central axis.

Existing containers, e.g. burner-heated hot water boilers can benerally be readily reequipped to the inventive construction, if the continuous flow heater is constructed for connection to the outside of the container and preferably has connecting openings at the inlet and outlet sides at right angles to the heating duct for connecting to an upright container wall. The continuous flow heater can be connected to the container in electrically insulatable isolated manner, so that electrolysis problems are not of concern. In the case where the continuous flow heater is connected to the outside of the container, this can e.g. be achieved in that the liquid-carrying connections contain, in the form of intermediate members, hose portions made from non-conductive material, e.g., plastic. The connections between the continuous flow heater and container can be constructed in such a way that the heater is only carried by these connections and consequently requires no further support or fixing.

To further increase efficiency and improve maintenance, two or more separate heating ducts, particularly identical and/or parallel heating ducts, emanate from the collector and preferably issue into a mixing casing upstream of the continuous flow heater outlet. On the side of the mixing casing facing the inlet to the heating ducts it is in particular provided with a closable access opening, so that direct inspection and cleaning of the interior of the heating ducts is readily possible.

A simple heating means construction is obtained in that the heating duct, which in particular may be cross-sectionally annular, and/or the downflow duct is in each case formed by a pipe.

The use of pipes, particularly cylindrical pipes also offers the possibility of fitting the tubular heaters very simply in good thermally conducting connection. According to the invention this can be achieved in that the tubular heater is fitted to the continuous flow heater or heating duct, particularly as a prestressed or biased coil, and is thermally conductively combined with the associated wall by alloying or some similar solder-like connection.

It is conceivable to make the collector and/or continuous flow heater such that the collector is accessible through the upper, large-area opening of the heater, e.g. through the downflow duct, for emptying purposes. However, emptying is much simpler if the collector has a base cover and/or is formed by a pot or the like removable from the continuous flow heater, so that the collector can be simply emptied from the bottom. If a sliding check valve or the like is provided in each line connection of the continuous flow heater with the container, it is possible to clean the collector at any time independently of the emptying of the container by shutting off the line connection or connections.

For temperature regulation or running dry protection purposes, it is advantageous to provide adjacent to the tubular heater and/or in the liquid flow path in the continuous flow heater at least one reception tube for the removable arrangement of the sensor of a temperature regulator. Thus, the temperature is monitored by means of the sensor in or on the continuous flow heater instead of in the container, so that further simplification of maintenance and assembly of the electrical heating means is obtained.

In order to obtain a particularly effective protection against running dry, the reception tube for the temperature sensor is appropriately soldered adjacent to the tubular heater to the latter and/or to the wall of the heating duct or is fixed by clips which closely surround it in thermally conducting manner.

Other than for hot water boilers and the like, the inventive construction is particularly advantageous as a heating register for washing machines, dishwashers, etc. The heating means according to the invention can also be used for heating liquids other than water, e.g. frying fat for deep fat fryers, where once again the provision of a continuous flow heater permits simple cleaning of the fryer container and simple removal of the solids obtained when frying.

BRIEF DESCRIPTION OF THE DRAWINGS

The invention is described in greater detail hereinafter relative to non-limiting embodiments and the attached drawings, wherein show:

FIG. 4 A further embodiment of a heating means in a representation corresponding to FIG. 1.

FIG. 5 A plan view of the heating means according to FIG. 4.

FIG. 6 A detail of FIG. 4 on a larger scale.

DETAILED DESCRIPTION OF THE PREFERRED EMBODIMENTS

Figure 1:
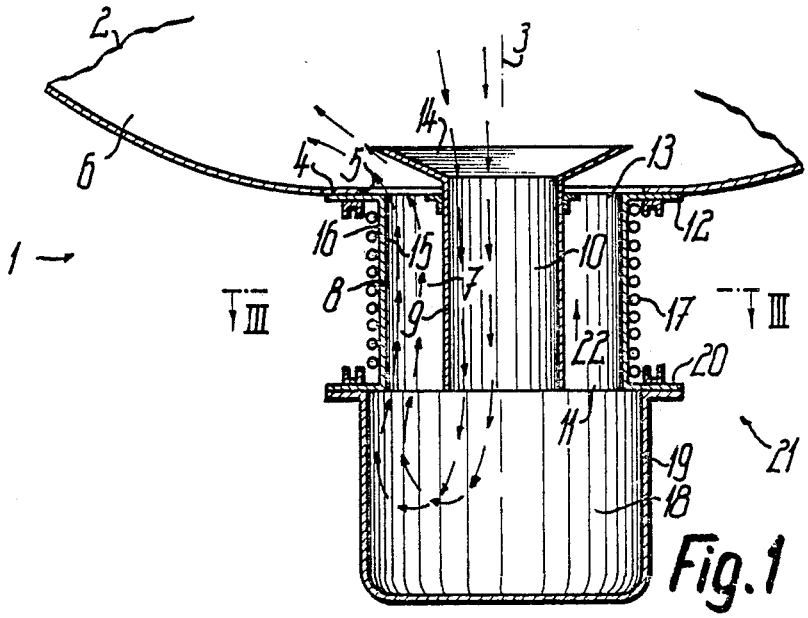
FIG. 1 An axial section through a heating means according to the invention.
Figure 2:
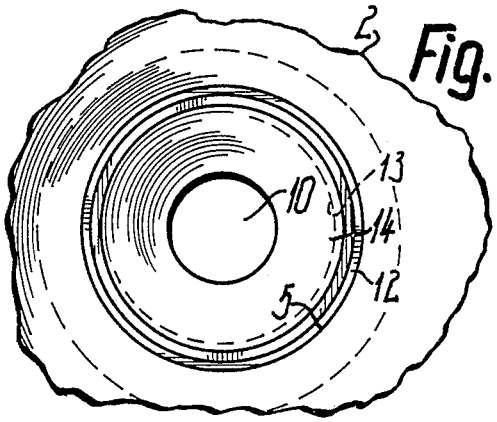
FIG. 2 A plan view of the heating means according to FIG. 1.
Figure 3:
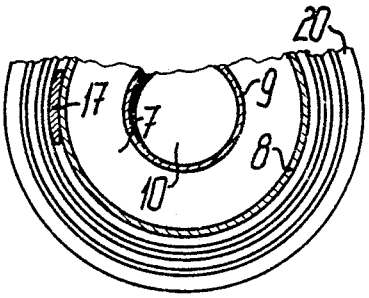
FIG. 3 A section along line III—III of FIG. 1.

The heating means 1 according to FIGS. 1 to 3 is associated with a container 2, e.g. a hot water boiler, which is provided with supply and drain lines (not shown) for the liquid to be heated. Container 2 is substantially symmetrical to a vertical central axis 3 and with respect to its central axis, said heating means is entirely located in central axis 3. Heating means 1 is positioned in the vicinity of an opening 5 on the bottom 4 of container 2 and partly projects through the central, e.g. circular opening 5 into the container interior 6.

Heating means 1 has a vertical, cross-sectionally circular heating duct 7, which is radially outwardly bounded by a tubular wall 8 and radially inwardly by a tubular wall 9 which is equiaxial to wall 8. Wall 9 surrounds or bounds a downflow duct 10 positioned equiaxially in heating duct 7 and only separated from the latter by wall 9. The lower end of duct 10, roughly in the plane of the lower end of wall 8, is level with the circular liquid inlet 11 for the heating duct 7. At the upper end, tubular wall 8 has a flange 12 for the sealed fixing to the underside of the container bottom 4, the width of opening 5 being at least as large as the greatest width of heating duct 7. The upper end of heating duct 7, level with said flange 12, forms its circular liquid outlet 13 issuing directly into container 6. The upper end of wall 9 or the downflow duct 10 is widened in obtuse-angled, funnel-shaped manner 14 just above liquid outlet 13 to a width which is greater than the maximum width of outlet 13 or the heating duct 7 which has substantially constant cross-sections over its height. Thus, the upper end of wall 9, apart from an inlet for the downflow duct 10 constricting in funnel-shaped manner downwards to the width of duct 10, forms an annular flow guidance member, which slopes upwards in axial section and is positioned annularly around the central axis 3. In plan view on the heating means, said guidance member completely covers the outlet 13 of heating duct 7. Thus, the flow guidance member 14 effectively separates the liquid flow guided into heating means 1 from the liquid flow guided from heating means 1 into container 2. Therefore the heated liquid leaving heating means 1 is uniformly upwardly guided about central axis 3 along the wall of container 2, is deflected downwards in the upper region of container 2 and is finally supplied in circuit to the downflow duct 10 again for further heating purposes.

The outer wall 8 of heating duct 7 is provided on the outside 16, remote from inside 15 and which is subject to liquid action and namely on the outer circumference thereof with an electric tubular heater 17, which is fixed in closely engaging and therefore good heat conducting manner to said side 16, e.g. by soldering or the like. The tubular heater surrounds wall 8 in helical manner and it is possible to provide two or more helical heater coils, which can be switched in separately in the manner of a multiple coil, so as to have the possibility of operating the heating means 1 at different power levels. The tubular heater 17 extends substantially over the entire length of heating duct 7 or wall 8.

Below the inlet 11 to heating duct 7 is provided a deflecting and collecting space 18, whose central axis coincides with central axis 3 and whose width is at least as great as the maximum width of the heating duct 7, so that the heating duct 7 is open over its entire cross-sectio downwards to collector 18. Collector 18 is formed by a pot 19, which is fixed in easily detachable, but sealed manner to a lower flange 20 of wall 8. The liquid passing out of the lower outlet of downflow duct 10, located in the plane of inlet 11, is deflected in collector 18 radially outwards and upwards into heating duct 7, the solids dropping into the relatively low-flow lower region of the collector 18 and depositing on the bottom thereof. Any solids depositing on the walls of heating duct 7, some of which regularly break off as a result of the thermal stresses which occur, also tend to drop to the bottom of collector 18 due to the relatively low flow rate in duct 7. Following the removal of pot 19, it is possible to empty the same and then heating duct 7 is completely accessible from below over its entire height, so that its walls can easily be cleaned.

As a result of the described construction, heating means 1 has a continuous flow heater 21 integrated with container 2 and which heats the content of the latter in circuit. The actual heating zone is located in the vicinity of heating duct 7, where the flow is directed from bottom to top according to arrow 22.

Figure 11:
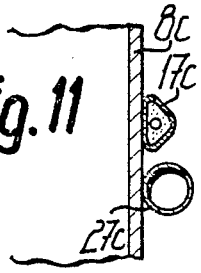
FIG. 11 A detail of FIG. 10 in a further embodiment.
Figure 12:
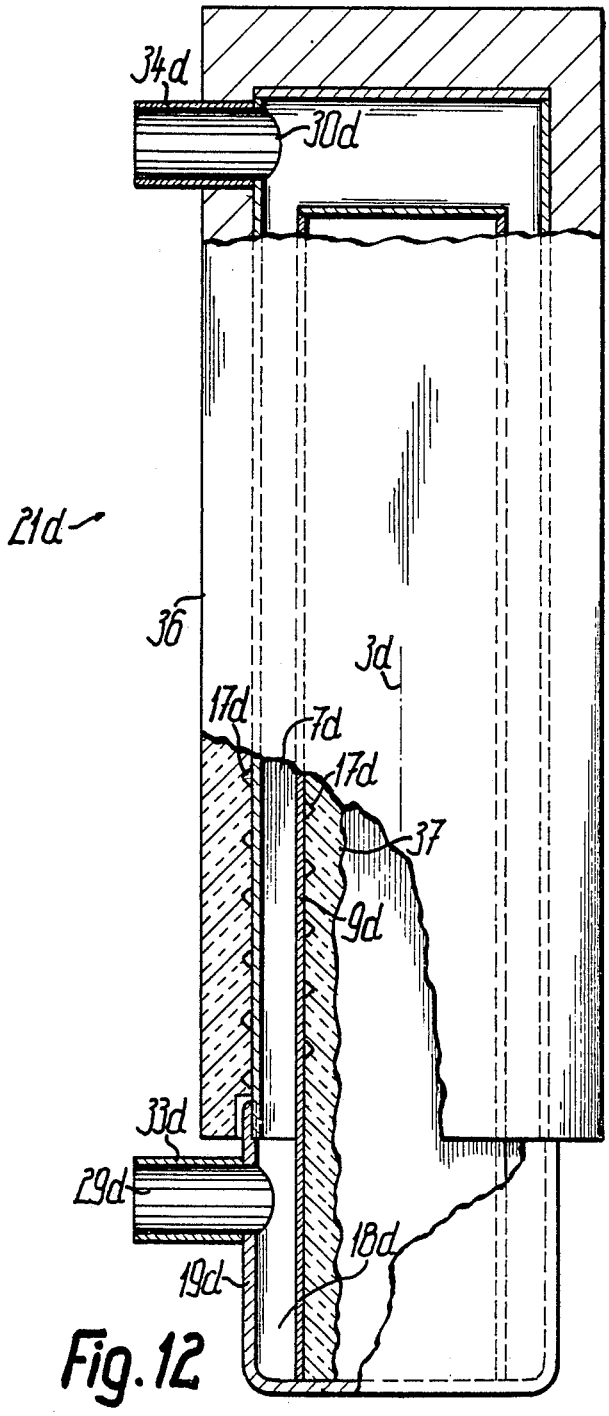
FIG. 12 A further embodiment of a heating means in part sectional view.
Figure 13:
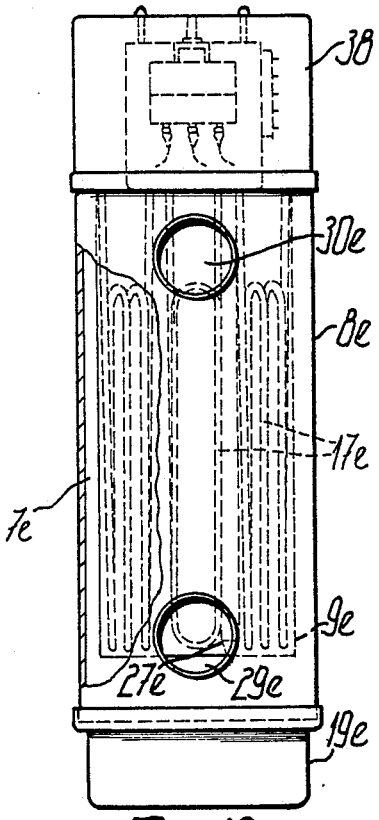
FIG. 13 A further embodiment of a heating means in a representation corresponding to FIG. 7.
Figure 14:
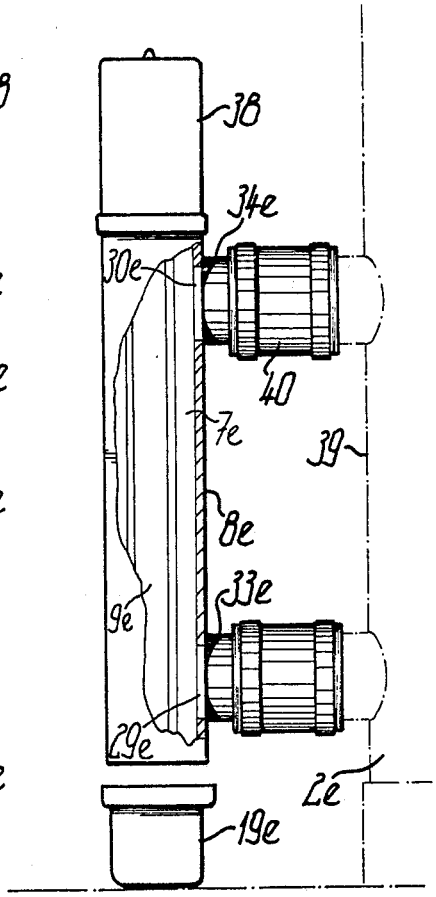
FIG. 14 The heating means according to FIG. 13 in side view.
Figure 15:
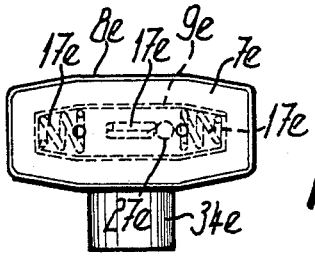
FIG. 15 The heating means according to FIG. 13 in plan view.

In FIGS. 4 to 15 corresponding parts are given the same reference numerals as in FIGS. 1 to 3, but followed by the letter a in FIGS. 4 to 6, b in FIGS. 7 to 10, c in FIG. 11, d in FIG. 12 and e in FIGS. 13 to 15.

In the embodiment according to FIGS. 4 to 6, the container bottom **4*a* is provided with a bottom flange 5*a*, to which is fixed, by its upper flange 12*a*, the tubular wall 8*a* bounding the heating duct 7*a* on a radially outer circumference. The two engaging flanges are secured with a detachable profile ring 23, whilst interposing a ring seal 24** engaging round the same.

Wall **8*a* extends over the entire height of the continuous flow heater 21*a*, so that it also simultaneously bounds collector 18*a* and projects downwards by the height of collector 18*a* with respect to the lower end of wall 9*a*. To the lower end of wall 8*a* is fixed a detachable bottom cover 25, so that the interior of wall 8*a* is accessible over the entire width through the removal of cover 25. The upper end of wall 9*a* forms a plurality of roughly radially outwardly projecting fastening plates 26 uniformly distributed about the central axis 3*a* and which are fixed by bent or offset ends to the inside of the container bottom 4*a*. Thus, following the removal of wall 8*a*, the outside of wall 9*a*** is readily accessible.

As can in particular be seen in FIG. 6, the tubular heater **17*a*, can also be flattened for engagement on the associated side 16*a* of wall 8*a*, e.g. can be given a triangular cross-section, so that there is an even better heat transfer from tubular heater 7*a* to wall 8*a*. Adjacent tubular heater 17*a*, at least one reception tube 27 is fixed in good heat conducting manner to the same side 16*a* of wall 8*a* and serves to receives the temperature sensor 28** of a temperature regulator, e.g. filled with an expansion fluid. In the same or a similar manner, it is also possible to provide a reception tube for a temperature sensor of a running dry protection means, said reception tube being appropriately in direct thermally conducting contact with the tubular heater.

FIGS. 7 to 10 show a continuous flow heater **21*b* having openings 29, 30 for connection to the container (not shown) transversely or at right angles to the flow direction indicated by arrow 22*b* of several heating ducts 7*b*. Pot 19*b* defining the collector 18*b* has its opening closed by a detachable cover 25*b* on the underside. To the upper base of pot 19*b* are connected three parallel and identical pipe sections 8*b*, which are in a common axial plane and in each case bound one heating duct 7*b*, being provided on the outer circumference with a separate helical tubular heater 17*b*. The internal spacing between adjacent pipe sections 8*b* is smaller than the diameter thereof. The upper ends of the pipe sections and therefore heating ducts 7*b* are connected to the bottom of an also pot-shaped, common mixing casing 31, whose upper pot opening is also closed by an easily detachable cover 32. The inflow connection opening 29 of the continuous flow heater 22*b* is provided in a wall of pot 19*b*, whilst the outlet connecting opening 30 axially parallel thereto and vertically superimposed with respect thereto is located on the associated wall of mixing casing 31. The two connecting openings 29, 30 can be formed by projecting connecting pieces 33, 34. As a result of this construction, the continuous flow heater 21*b* can be simply subsequently joined to the outside of a container. In addition, following the removal of covers 35*b*, 32, the heating ducts 7*b*** are easily accessible for cleaning or other purposes.

On the outsides of pipe sections **8*b* is fixed a common reception tube 27*b* for a temperature sensor having a running dry protection function. The reception tube 27*b* tangentially engaging on all pipe sections 8*b* is positioned between each heating duct 7*b* between two turns of the associated tubular heater 17*b*, which can be in direct contact therewith. The temperature sensor is inserted in reception tube 27*b*, which is open at one end, so that it can always be removed again and, e.g., replaced. The same applies with respect to a second reception tube 35, which is provided in the liquid flow path within the continuous flow heater 21*b*, namely in the upper region of collector 18*b*. The closed end of reception tube 35 is positioned within collector 18*b*, whilst the other open end of the sealed reception tube 35 passing outwards through a wall of heater 21*b* is positioned in freely accessible manner on the outside of heater 21*b***. Thus, the associated temperature sensor, which is appropriately associated with a temperature regulator, can be replaced at any time. For this purpose, the reception tubes are substantially linear or only slightly curved, so that the temperature sensor can be adequately easily inserted and removed.

Figure 7:
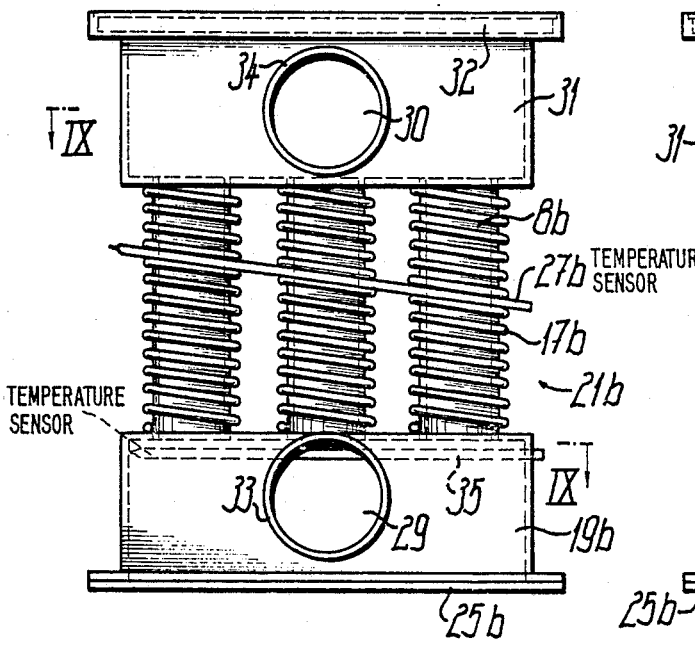
FIG. 7 Another embodiment of a heating means in a view on the connection side.
Figure 8:
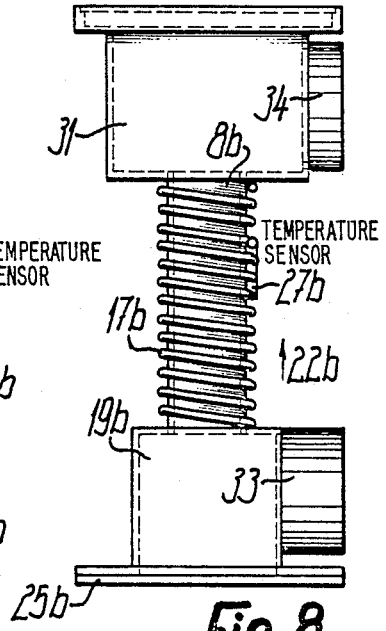
FIG. 8 The heating means according to FIG. 7 in side view.
Figure 9:
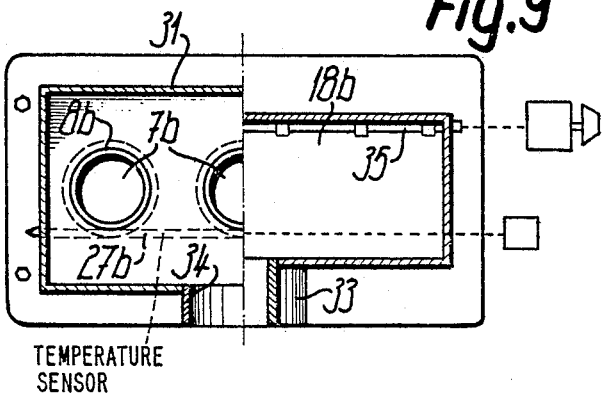
FIG. 9 A section along line IX—IX of FIG. 7.
Figure 10:
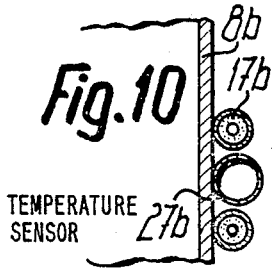
FIG. 10 A detail of FIG. 8 in sectional, larger-scale representation.

In the case of the continuous flow heater according to FIGS. 7 to 9, the tubular heaters 17*c* according to FIG. 11 can also have flattened engagement faces or a triangular cross-section.

The continuous flow heater 21*d* according to FIG. 12 is also constructed for arrangement on the outside of a container. The cross-sectioally circular heating duct 7*d* is bounded by two coaxial, tubular walls 8*d*, 9*d*, the outer wall 8*d* being provided on the outside with at least one tubular heater 7*d* and the inner wall 9*d* on the inside with at least one tubular heater 17*d*, so that a greatly enlarged contact surface is provided for heating the liquid flowing through heating duct 7*d*. Such a construction would also be conceivable in the case of the provision of a downflow duct according to FIGS. 1 to 6, the wall of said duct then being positioned within the inner tubular heater 17*d*. To increase efficiency or avoid heat losses, the outer tubular heater 17*d* or the associated wall 8*d* is covered by a thermal insulation 36 and the inner tubular heater 17*d* with a thermal insulation 37. The inner insulation 37 can completely fill the inner cavity of wall 9*d*. The inflow connecting opening 29*d* of the continuous flow heater 21*d* or the associated connecting piece 33*d* is appropriately provided on the pot 19*d* adjacent to collector 18*d* and which can e.g. be detachably screwed on to an outer thread of the outer tubular wall 8*d*. If the inner wall 9*d* is also fixed to this pot 19*d*, on detaching said pot, it can be completely removed from outer wall 8*d*, thereby permitting very simple cleaning of the complete continuous flow heater 21*d*.

As shown in FIGS. 13 to 15, the inner wall 9*e* of the annular heating duct 7*e*, which in this case differs in cross-section from a circular shape, can also be arranged in suspended manner in the outer wall 8*e*. The upper end of wall 9*e* is fixed to a switch box 38 for the tubular heater 17*e*, which simultaneously forms the upper, detachable end cover of outer wall 8*e*. Thus, inner wall 9*e*, including the tubular heater 17*e* can be removed upwards out of the outer wall 8*e* together with the switch box 38. In the represented embodiment, tubular heaters 17*e* are only provided on the inside of inner wall 9*e*.

Pot 19*e* bounding the collector, which is shown in the removed state in FIG. 14, is detachably fixed to the underside of outer wall 8*e*, so that it can be emptied at all times. If pot 19*e* and switch box 38 are removed, then the complete inner area surrounded by wall 8*e* is freely accessible for maintenance purposes.

As is further shown in FIG. 14, container 2*e*, indicated by dot-dash lines, is provided on an upright or vertical container wall 39 with two parallel, substantially vertically superimposed connecting pieces, whose reciprocal spacing is adapted to the spacing between connecting pieces 33*e*, 34*e*. The connecting pieces of the continuous flow heater 21*e* are connected to the connecting pieces of container 2*e* via fitted connecting sleeves 40 made from rubber or some similar material and sleeves 40 are, e.g., secured with clips. As a result the continuous flow heater 21*e* can at any time be completely removed from container 2*e*.

A continuous flow heater is also conceivable, whose outer wall has a bulging, flattened or oval shape corresponding to wall 8*e* in FIG. 15 and on to whose outside is wound at least one tubular heater, as in the embodiment according to FIGS. 7 to 9. The top and/or bottom of the wall can be closed by in each case one removable, cross-sectionally corresponding cover, which has a connecting piece for the supply or removal of the liquid to be heated. Furthermore, the wall can be formed from portions assembled in the longitudinal direction, whereof each carries at least one separate tubular heater, so that by adding or removing such portions, which can have an identical construction, it is possible to increase or decrease the caloric power of the continuous flow heater. Appropriately the portions engaged by their end faces in positive, sealed manner in one another, said faces being constructable in such a way that they are also suitable for the positive sealed engagement of the end covers. As a result of the flattened construction of the continuous flow heater, favourable dimensions for a space-saving location are provided. The outer wall of the continuous flow heater can also be given a drum shape, e.g. can bulge towards the centre of its length, in such a way that its cross-sections are smaller in the vicinity of its ends than in the vicinity of the centre of its length.

What is claimed is:

1. An electrical heating means for liquid contained in a liquid container, comprising:

at least one heating resistor (17*b*) and a continuous flow heater (21*b*) heated by the heating resistor (17*b*), said continuous flow heater (21*b*) having an inlet side (29) and an outlet side (30) ducted for connection to the container and defining a liquid flow path, said flow path of said continuous flow heater (21*b*) including heating duct means (7*b*) bounded by at least one tubular wall portion (8*b*) having lower and upper ends, a length extension and an interior, said lower end being connected to a separate inflow chamber (19*b*) below said duct means and having an entire width substantially at least as wide as a maximum width across the heating duct means (7), said inflow chamber (19*b*) having a chamber opening closed by a removable closure means (25*b*); and, wherein said inflow chamber (19*b*) is a collector for solids to be separated from the liquid, said inflow chamber (19*b*) being defined by a pot-shaped body having a large-area removal opening closed by the closure means (25*b*), said removal opening, when open, providing access to the interior of said inflow chamber (19*b*) substantially over the entire width thereof and providing substantially full access to the interior of the heating duct means.

2. The heating means according claim 1, wherein said pot-shaped body (19*b*) has an upper side and an under side, said removal opening being provided on the under side and an opposite wall connected to the heating duct means (7*b*) being provided on the upper side, said closure means (25*b*) being a detachable lower cover.

3. The heating means according to claim 1, wherein said access to the heating duct means (7) is provided from below.

4. The heating means according to claim 1, wherein said heating duct means (7) is open to the inflow chamber (19*b*) over a maximum inner width of said heating duct means.

5. The heating means according to claim 1, further comprising means for providing access to the heating duct means (7) through the upper end thereof.

6. The heating means according to claim 1, wherein said upper end of the heating duct means (7*b*) is ducted to a separate outflow chamber (31) having access opening detachably closed by a cover (32).

7. The heating means according to claim 6, wherein said outflow chamber (31) has a side facing the upper end of the heating duct means (7*b*), said access opening and said cover (32) being provided on a side facing away from said heating duct means (7*b*).

8. The heating means according to claim 1, wherein each said at least one tubular wall portion (7*b*) is defined by a pipe section (8*b*) having lower and upper ends, said pipe section (8*b*) being connected to an upper wall of said inflow chamber (19*b*).

9. The heating means according to claim 8, wherein said upper end of each of the at least one pipe section (8*b*) is connected to a bottom wall of an outflow chamber (31).

10. The heating means according to claim 9, wherein at least two tubular wall portions (8*b*) are disposed substantially parallel and adjacent to one another, said outflow chamber (31) being a mixing chamber and said inflow chamber (19*b*) being a distributing chamber.

11. The heating means according to claim 1, wherein said heating resistor (17*b*) is a tubular heating conductor helically arranged around each said at least one tubular wall portion (8*b*).

12. The heating means according to claim 1, wherein a plurality of tubular wall portions (8*b*) are arranged in a common plane.

13. An electrical heating means for liquid contained in a liquid container, comprising:

at least one heating resistor (17*b*) and a continuous flow heater (21*b*) heated by the heating resistor (17*b*), said continuous flow heater (21*b*) having an inlet side (29) and an outlet side (30) for ducted connection to the container and defining a liquid flow path, said liquid flow path being defined by heating duct means (7) bounded by at least one tubular wall portion (8*b*) having lower and upper ends, a length extension and an interior, said lower end being connected to a separate inflow chamber (19*b*) having an entire width substantially at least as wide as a maximum width of the heating duct means (7), said inflow chamber (19*b*) having a chamber opening closed by a removable closure means (25*b*), and, wherein at least one temperature sensor (27*b*, 35) of a temperature control means is provided adjacent at least one of said tubular wall portions (8*b*).

14. The heating means according to claim 13, wherein one of said at least one temperature sensor is provided in common for at least two adjacent ones of a plurality of tubular wall portion (8*b*).

15. The heating means according to claim 13, wherein at least one of said temperature sensors is provided in common for all of a plurality of adjacent tubular wall portions (8*b*).

16. The heating means according to claim 13, wherein one said at least one temperature sensor is provided on an outside of the at least one tubular wall portion.

17. The heating means according to claim 13, wherein one said at least one temperature sensor is provided in a tangential orientation with respect to the tubular wall portion (8*b*).

18. The heating means according to claim 13, wherein said heating resistor (17*b*) has adjacent circumferential sections, one said at least one temperature sensor (27*b*) being provided between the adjacent circumferential sections of the heating resistor.

19. The heating means according to claim 13, wherein one said at least one temperature sensor (35) is exposed to liquid flow in the liquid flow path.

20. The heating means according to claim 13, wherein one said at least one temperature sensor (35) is provided within the continuous flow heater (21*b*).

21. The heating means according to claim 13, wherein one said at least one temperature sensor (35) is provided in the inflow chamber (19*b*).

22. The heating means according to claim 21, wherein said one said at least one temperature sensor is provided in an upper region of the inflow chamber (19*b*).

23. The heating means according to claim 13, wherein a reception means (27*b*, 35) is provided for at least one said at least one temperature sensor.

24. The heating means according to claim 23, wherein said reception means is a reception tube.

25. The heating means according to claim 23, wherein said reception means (35) has a closed end exposed to the liquid flow and an open end located to be freely accessible on an outside of the continuous flow heater (21*b*), said reception means (35) penetrating a wall confining said liquid flow.

26. The heating means according to claim 23, wherein the reception means (27*b*) for the said at least one temperature sensor is soldered adjacent to the heating resistor (17*b*).

27. The heating means according to claim 23, wherein the reception means is is soldered to the at least one tubular wall portion (8*b*) of the heating duct means (7*b*).

28. The heating means according to claim 23, wherein the reception means (27*b*) is fixed by thermally conductive surrounding clips.

29. The heating means according to claim 13, wherein one said at least one temperature sensor is associated with a running dry protection device operative as a thermal cutout.

30. The heating means according to claim 13, wherein one said at least one temperature sensor is associated with a temperature regulator.

31. The heating means according to claim 13, wherein at least one said at least one temperature sensor is filled with an expansion fluid.

* * * * *

UNITED STATES PATENT AND TRADEMARK OFFICE

CERTIFICATE OF CORRECTION

PATENT NO. : 4,825,043

DATED : April 25, 1989

INVENTOR(S) : Herman Knauss

It is certified that error appears in the above-identified patent and that said Letters Patent is hereby corrected as shown below:

IN THE SPECIFICATION:

Colum 2, line 10, "decreased" should be --decreases--.

Column 2, line 56, "benerally" should be --generally--.

IN THE CLAIMS:

Column 9, Claim 6, line 3, before "access" insert --an--.

IN THE ABSTRACT:

Line 4, "(ib)" should be --(8b)--.

Signed and Sealed this

Twenty-seventh Day of November, 1990

*Attest:*

HARRY F. MANBECK, JR.

*Attesting Officer*

*Commissioner of Patents and Trademarks*